US009180937B2

(12) United States Patent
Wallace

(10) Patent No.: US 9,180,937 B2
(45) Date of Patent: Nov. 10, 2015

(54) SAFETY BUOY

(71) Applicant: RIP BUOY HOLDINGS LIMITED, Port Macquarie, New South Wales (AU)

(72) Inventor: Neil John Wallace, Port Macquarie (AU)

(73) Assignee: RIP Buoy Holdings Limited, Port Macquarie, NSW (AU)

( * ) Notice: Subject to any disclaimer, the term of this patent is extended or adjusted under 35 U.S.C. 154(b) by 0 days.

(21) Appl. No.: 14/351,196

(22) PCT Filed: Oct. 12, 2012

(86) PCT No.: PCT/AU2012/001237

§ 371 (c)(1),
(2) Date: Apr. 15, 2014

(87) PCT Pub. No.: WO2013/053012

PCT Pub. Date: Apr. 18, 2013

(65) Prior Publication Data

US 2014/0273676 A1 Sep. 18, 2014

(30) Foreign Application Priority Data

Oct. 14, 2011 (AU) ..... 2011904226

(51) Int. Cl.
*B63B 22/00* (2006.01)
*B63C 9/08* (2006.01)
*B63B 22/18* (2006.01)

(52) U.S. Cl.
CPC ..... *B63B 22/00* (2013.01); *B63B 22/18* (2013.01); *B63C 9/08* (2013.01)

(58) Field of Classification Search
CPC ..... B63C 9/08; B63B 22/18; B63B 22/00
USPC ..... 441/1, 40
See application file for complete search history.

(56) References Cited

U.S. PATENT DOCUMENTS

| | | | | |
|---|---|---|---|---|
| 1,375,494 | A * | 4/1921 | Dudas | 441/1 |
| 3,147,498 | A | 9/1964 | Convis | |
| 4,666,414 | A * | 5/1987 | Fox et al. | 441/129 |
| 4,747,797 | A * | 5/1988 | Hindle | 441/38 |
| 4,903,243 | A * | 2/1990 | Turner, Jr. | 367/3 |
| 4,927,395 | A * | 5/1990 | Saulnier et al. | 441/26 |
| 5,609,120 | A * | 3/1997 | Eronen | 114/253 |

(Continued)

FOREIGN PATENT DOCUMENTS

| | | | |
|---|---|---|---|
| AU | 2010100100 | A4 | 3/2010 |
| GB | 795194 | A | 5/1958 |

OTHER PUBLICATIONS

International Search Report for PCT/AU2012/001237, mailed Dec. 17, 2012; ISA/AU.

*Primary Examiner* — Lars A Olson
*Assistant Examiner* — Jovon Hayes
(74) *Attorney, Agent, or Firm* — Harness, Dickey & Pierce, PLC

(57) ABSTRACT

A safety buoy (100) for use in a rip current area (35) having a rip current comprises a bow section (110) and a stern section (120). The bow section (110) is streamlined and the stern section (120) has a deck area. The safety buoy (100) is advantageously moored in the rip current area (35) so that the streamlined bow faces generally seaward towards incoming swell conditions, while the deck area at the stern section (120) faces generally shoreward and provides a surface for a distressed bather caught in an outgoing rip current.

28 Claims, 9 Drawing Sheets

(56) References Cited

U.S. PATENT DOCUMENTS 5,687,664 A * 11/1997 Sofian ..... 114/61.25
5,810,695 A * 9/1998 Sass ..... 482/27
6,508,682 B1 * 1/2003 Clark ..... 441/40
6,634,914 B2 * 10/2003 Vancil ..... 441/40
8,057,091 B2 * 11/2011 Tormaschy et al. ..... 366/264
8,804,461 B2 * 8/2014 Imran ..... 367/134
2011/0207377 A1 8/2011 Hawthorne
2014/0273676 A1 * 9/2014 Wallace ..... 441/1

* cited by examiner

SAFETY BUOY

CROSS-REFERENCE TO RELATED APPLICATIONS

This application is a 371 U.S. National Stage of International Application No. PCT/AU2012/001237, filed Oct. 12, 2012, which claims priority to Australian Patent Application No. 2011904226, filed on Oct. 14, 2011, the disclosures of which are herein incorporated by reference in their entirety.

FIELD OF THE INVENTION

The invention relates to marine safety, and relates more particularly to water safety equipment used at surf beaches and other marine environments such as coastal estuaries.

BACKGROUND OF THE INVENTION

Australia has many surf beaches, and in the early 1900's various surf lifesaving clubs and organisations formed to promote safety at surf beaches. Popular surf beaches have been patrolled by lifesavers or lifeguards ever since. Surf lifesaving equipment has changed considerably over the years. Surf rescues were once performed with a surf reel, or a surf boat, with both techniques requiring considerable strength and conditioning as well as a small crew of able lifesavers. These techniques are now historical for rescue purposes. Equipment that is currently favoured includes rescue tubes, rescue boards, inflatable rescue boats (IRBs) and jet skis. Helicopters may also be used when necessary and available, but widespread use is prohibitive due to their expense.

As is apparent, surf beaches present a considerable public safety challenge, particularly when frequented by those not familiar or confident with surf conditions. Due to the complexity of the surf environment, the approach of lifesavers and the accompanying public safety message has for many years been to direct bathers to swim "between the flags". A pair of distinctive red and yellow flags are positioned along the shoreline according to prevailing conditions to indicate an interval of the beach that is considered safe for bathing. Bathers are directed to swim between the flags for their own safety, and also to contain the area of beach that is more actively patrolled.

Despite the success of this approach, it is not without its limitations. Popular beaches tend to attract beachgoers having a wide diversity of surf experience and skills. Those lacking familiarity and confidence with surf conditions may not be aware of the importance of bathing only in designated areas and can often be drawn to calmer waters that lack breaking surf and thus appear safer. Unfortunately, these areas quite often harbour rip currents that can quickly find unsuspecting bathers out of their depth. This is disconcerting for those unable to swim well, and can be quite distressing for those unable to swim at all.

Many surf beaches are in fact prone to developing rip currents. Rip currents develop as a natural consequence of water flowing back out to sea after flowing into shore. Rip currents can vary in position, strength and direction and depend on local conditions. Rips may be permanent owing to the structure of the beach and marine surrounds, and any man-made structures. For example, rock formations, breakwaters, drainage channels and boat ramps may all contribute to permanent rip currents. Rip currents may also be temporary depending upon tide levels, and prevailing sand formations and winds.

Those experienced with reading surf conditions can identify rip currents due to various tell-tale signs. Typically a rip current shows no breaking surf. Instead, the area may be murky due to agitated sand beneath the water's surface, and sea foam and debris may be seen floating seawards. If there is large breaking surf nearby, the rip area more typically has a smoother surface with much smaller undulating waves. The water in a rip current area may also appear darker due to the water being deeper due to the absence of a sandbank. Rip currents typically flow out to sea, but can also flow along a beach. While rip currents occur predominantly at surf beaches, other marine environments such as coastal estuaries can also harbour dangerous currents.

While many improvements have been made to the working methods and safety equipment used by lifesavers over the years, significant effort and attention is required by lifesavers to rescue beachgoers caught in dangerous currents. This diverts attention from other beachgoers who may require assistance. Notwithstanding the efforts of lifesavers, a significant number of beachgoers drown every year in Australia, in the order of typically one drowning every two or three days.

A recent attempt at improved beach safety is published as US 2011/0207377, 25 Aug. 2011, in the name of Frederick William George, of Hawthorne, Queensland. Mr George envisions, in a typical configuration, a triangulated arrangement between spaced apart beach flags—conventionally indicating a safe bathing area—and floating lines that extend into the sea from the flags and meet at a safety buoy at a comparable distance out to sea. An advantage of this system is that bathers have a floating line to hold if distressed, and the safe bathing area is more emphatically demarcated for the benefit of beachgoers.

Similarly, another recent publication describes a marine safety buoy, namely AU 2010100100, published 4 Mar. 2010, in the name of Andrew David Curren, of Fadden, Australian Capital Territory. Mr Curren proposes using—moored in rip current areas—a buoy having suitable warning indicia. Mr Curren also contemplates using in the buoy some form of distress button and alert system for the benefit of distressed swimmers.

While the foregoing attempts represent contributions to the art of marine safety, the arrangements described are not the applicant's knowledge presently deployed in marine environments. Any further improvements in marine safety having practical and pragmatic application are accordingly welcome in view of the abovedescribed dangers of rip current areas.

SUMMARY OF THE INVENTION

The inventive concept of the present invention resides in recognition that a safety buoy for a rip current area can be provided with a shape which is generally buoyant and stable under typical marine conditions, and more particularly outgoing rip currents and incoming swell conditions, and which can be moored in a rip current area to indicate the presence and direction of a rip current, and provide a resting platform nearby bathers requiring assistance.

Existing safety buoys are overwhelmingly of a generally circularly or rotationally symmetric configuration, or at least substantially so, and while they may be used to effectively mark a dangerous rip area, such buoys are unsuited for the purposes and fail to secure the advantages of the safety buoy described herein.

A safety buoy for use in a rip current area comprises a bow, a stern and a hull, the bow having a streamlined prow and the stern having an open decked area above the hull, so that the safety buoy can be moored such that the streamlined prow generally faces seaward towards an incoming swell, and the open decked area generally faces shoreward towards an outgoing rip current, the open decked area thereby providing a resting platform for bathers caught in the rip current area.

The safety buoy described herein is of a generally longitudinal shape and streamlined prow and a wider stern having an open decked area. When positioned in a rip, the buoy is preferably moored fore and aft, with its bow facing generally seaward into oncoming swell, and its stern facing generally shoreward. The open decked area, facing generally shoreward, enabling bathers caught in a rip current to avail themselves of a resting platform which allows them to avoid being carried further by the rip.

The buoy desirably features a removably attachable trailing lifeline supported on the water surface by floats positioned at intervals along the length of the lifeline. The trailing lifeline indicates the direction of the prevailing rip current and also increases an area which bathers caught in the rip current may target to reach the safety of the buoy. Bathers reaching the trailing lifeline can pull themselves against the rip towards the deck area of the buoy.

Other desirable features of the buoy include a navigational light or strobe unit and a emergency radio beacon able to communicate with an emergency radio network. The strobe unit and radio beacon desirably operate under control of an electronic control unit that co-ordinates operation of the strobe unit and radio beacon according to predetermined settings in concert with a manual switch. Power is supplied by a solar power unit connected to the electronic control unit. Strobe units and emergency radio beacons are especially desirable for incorporation in buoys that are moored permanently in rip currents at particularly popular or hazardous locations. Buoys without such electronic equipment are better suited for temporary or day-by-day use in temporary rips.

The buoy can be positioned by a mooring block or anchor via a mooring chain. A mooring weight may also be used. The buoy preferably has a mooring points positioned fore and aft to allow the buoy to remain safely moored or anchored in large swells and strong currents.

A detailed, preferred embodiment of the present invention will be described in the following with reference to the accompanying drawings.

DESCRIPTION OF PREFERRED EMBODIMENTS

A safety buoy 100 is of assistance as lifesaving equipment for use in rip current areas. This may include ocean and estuary areas where there are rips or strong tidal flows. The safety buoy 100 can advantageously be moored within the general vicinity a rip current running in a rip current area, and used by those in the water if caught and swept up in the rip current.

Figure 1:
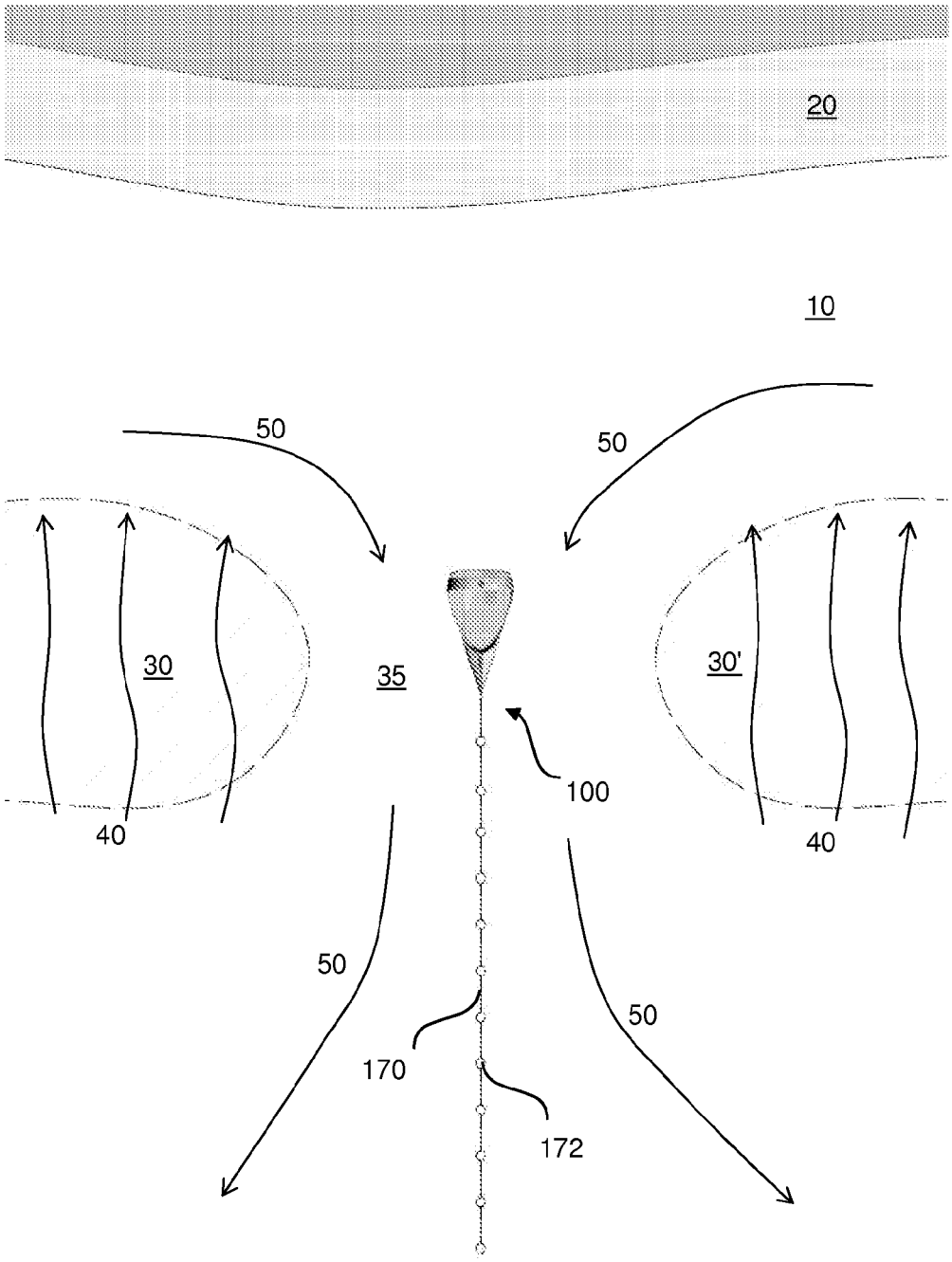
FIG. 1 is an aerial view in schematic form of a beach having a rip current area in which there is moored a safety buoy having a trailing lifeline in accordance with the present invention.

FIG. 1 illustrates an aerial schematic view of an ocean 10 breaking at a beach 20. Sandbars 30, 30' have formed a short distance from the shoreline of the beach 20. As is usual, there are waves breaking in the region of the sandbars 30, 30', as indicated by the arrows 40, 40' positioned over the sandbars 30, 30'. Between the sandbars 30, 30' there is a rip current 50 returning out to sea as indicated.

Located generally between the sandbars 30, 30' is a rip current area 35, where a safety buoy 100 can be secured in place by a mooring arrangement, which is below the waterline and not shown. Trailing behind the safety buoy 100 is a lifeline 170. The lifeline 170 is supported along its length by floats 172. The lifeline 170 may—as an example—be a dozen or so meters in length, formed in a rope suitable for marine applications, with floats 172 disposed along its length at intervals of say 1 meters to assist with buoyancy and visibility of the lifeline 170. The safety buoy 100 can also other cords or lines disposed around the safety buoy 100 to assist use of the safety buoy 100 when deployed in the water.

While not shown in FIG. 1, a mooring arrangement used to secure the safety buoy 100 can be of any convention and convenient arrangement, but is preferably as follows. The safety buoy 100 is preferably moored bore fore and aft, with the bow oriented seawards. A fore mooring line leads to a mooring anchor or mooring block (such as a formed concrete weight) with a heavy ground tackle that effectively anchors the fore mooring line and safety buoy 100.

The fore and aft mooring lines are attached to the safety buoy 100 by a suitable fixture or fastener arrangement at a suitable mooring take off point, respectively at fore and aft locations on the safety buoy 100.

A mooring arrangement adopted is advantageously adapted to maintain the buoyancy and stability of the safety buoy 100 in the face of outgoing rip currents and incoming swells, under prolonged and diverse conditions. The seaward facing orientation of the safety buoy 100 allows the safety buoy 100 to maintain its position, and allows ready access by distressed bathers.

FIGS. 2 to 8 depict the safety buoy 100 represented in context in FIG. 1, from a variety of perspectives.

The safety buoy 100 is, in contrast to existing buoys, of a generally longitudinal arrangement, and in this respect has a shape which is more closely akin to that of a seagoing vessel or watercraft rather than a conventional buoy per se. Due to this similarity, the safety buoy 100 is for this reason described herein with reference to FIGS. 2 to 8 using terms more typically used in connection with vessels or watercraft, either more generally or as regards aspects of naval architecture.

The safety buoy 100 in this respect broadly comprises two distinct sections—a bow 110, and a stern 120, both of which have at their underside a hull 130.

The bow 110 has a streamlined prow 112, formed as a straight prow, and the bow section itself is generally somewhat evocative of a dolphin nose, as depicted. The stern 120 has an open decked area or deck 150.

In use, the safety buoy 100 can be moored such that the streamlined prow 112 generally faces seaward towards an incoming swell, and the deck 150 generally faces shoreward towards an outgoing rip current, the deck 150 thereby providing a resting platform for bathers caught in the rip current area.

Figure 2:
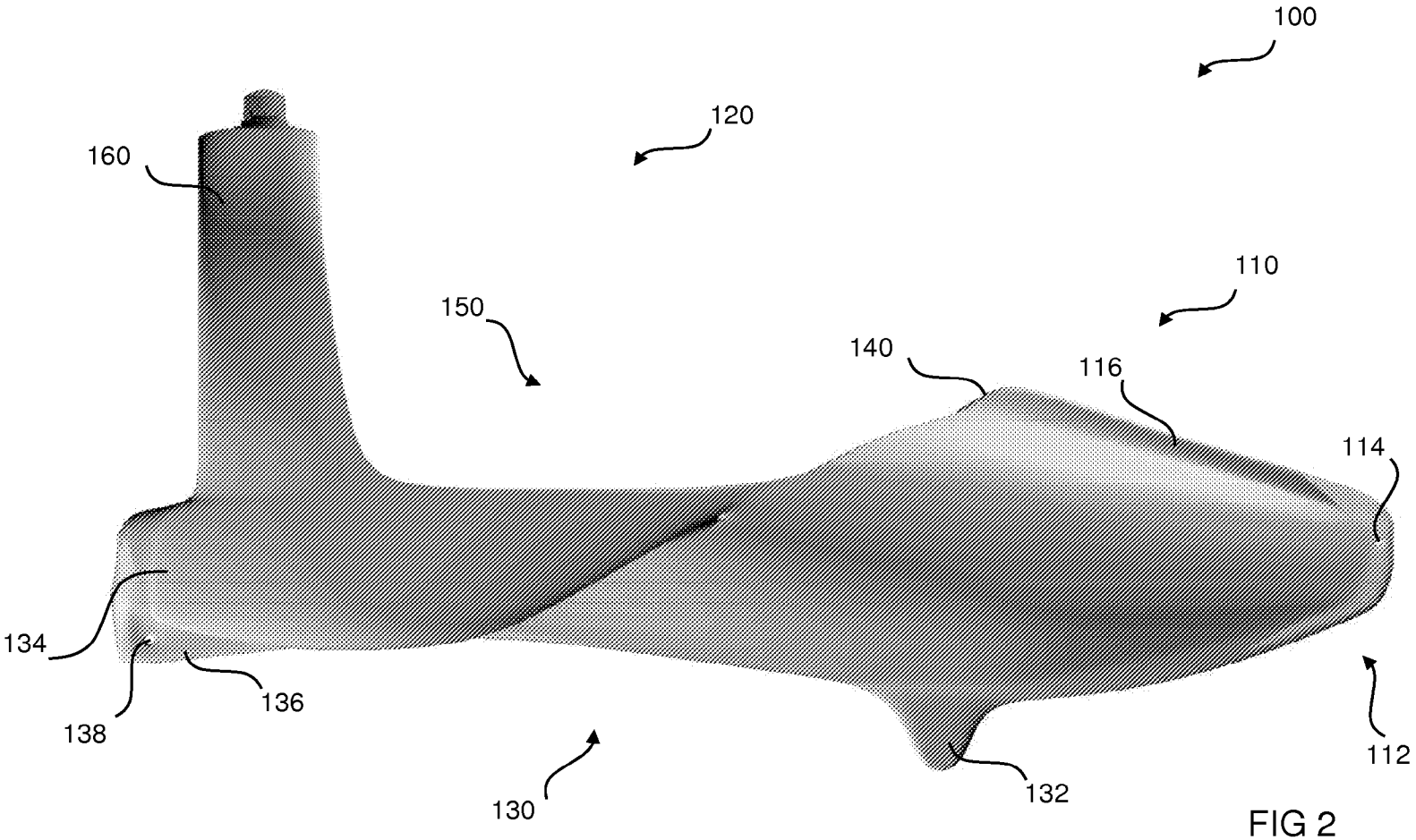
FIG. 2 is an elevation of the safety buoy depicted in FIG. 1.
Figure 3:
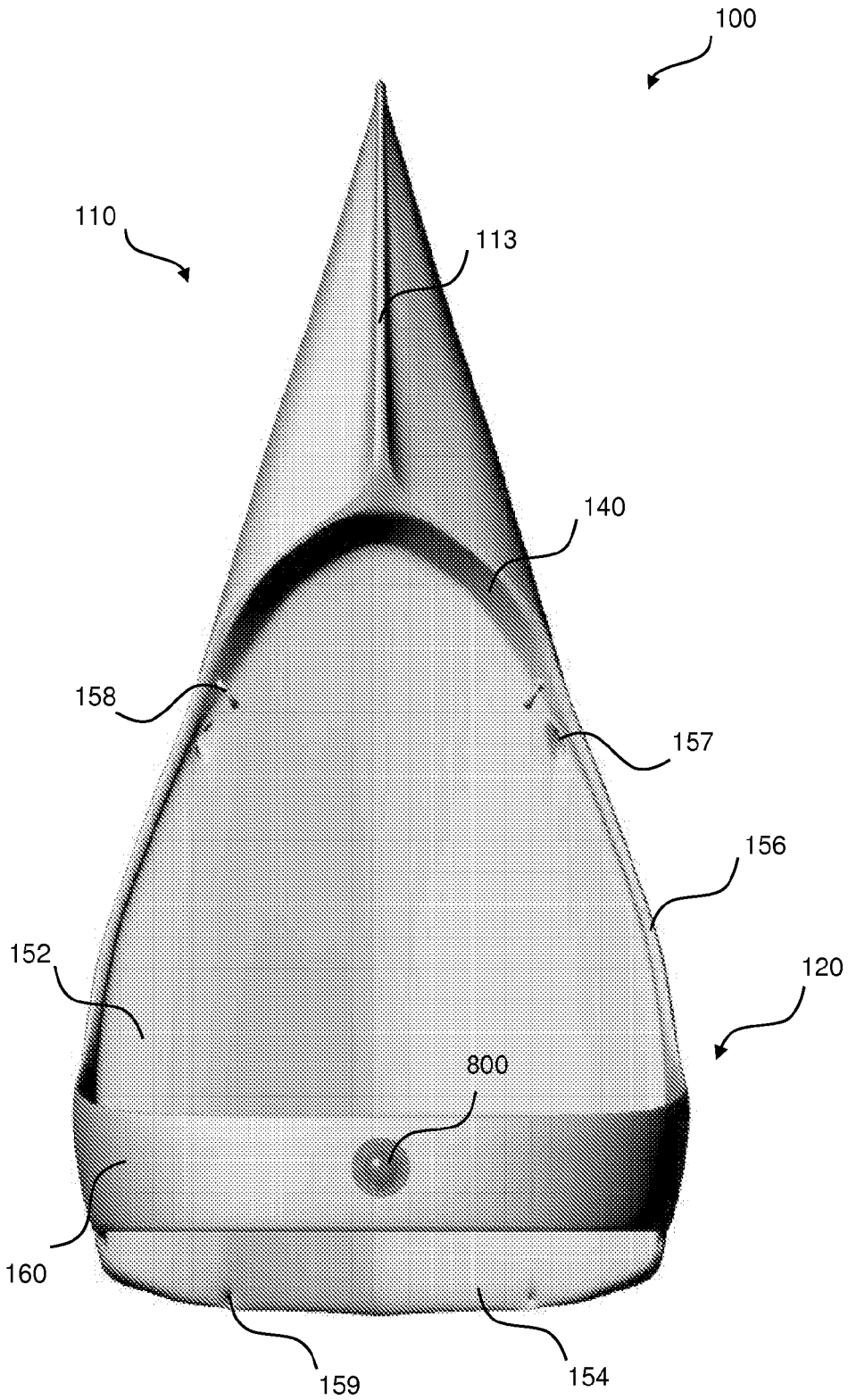
FIG. 3 is a plan view the safety buoy of FIG. 1.
Figure 4:
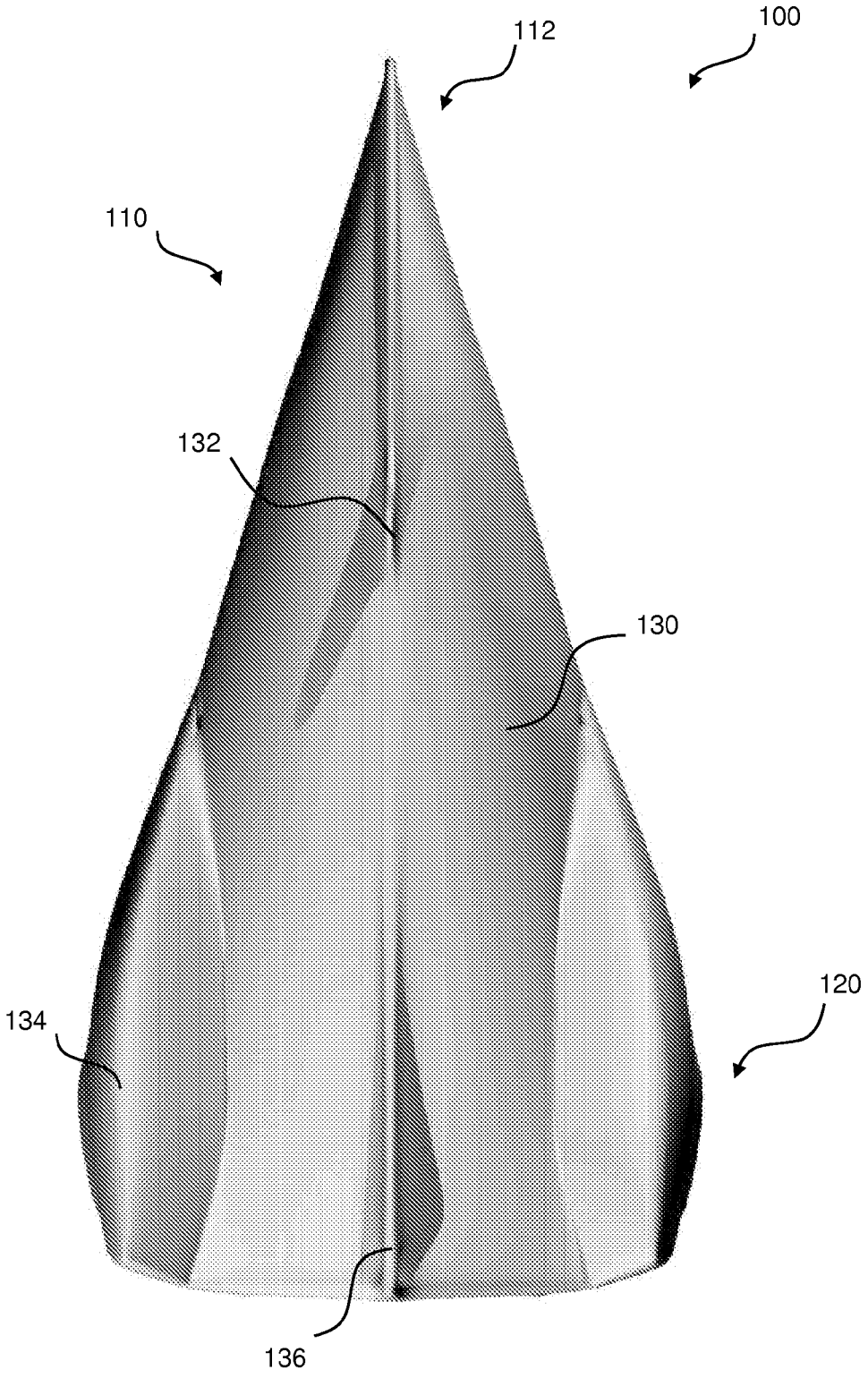
FIG. 4 is a view of the underside of the safety buoy of FIG. 1.
Figure 5:
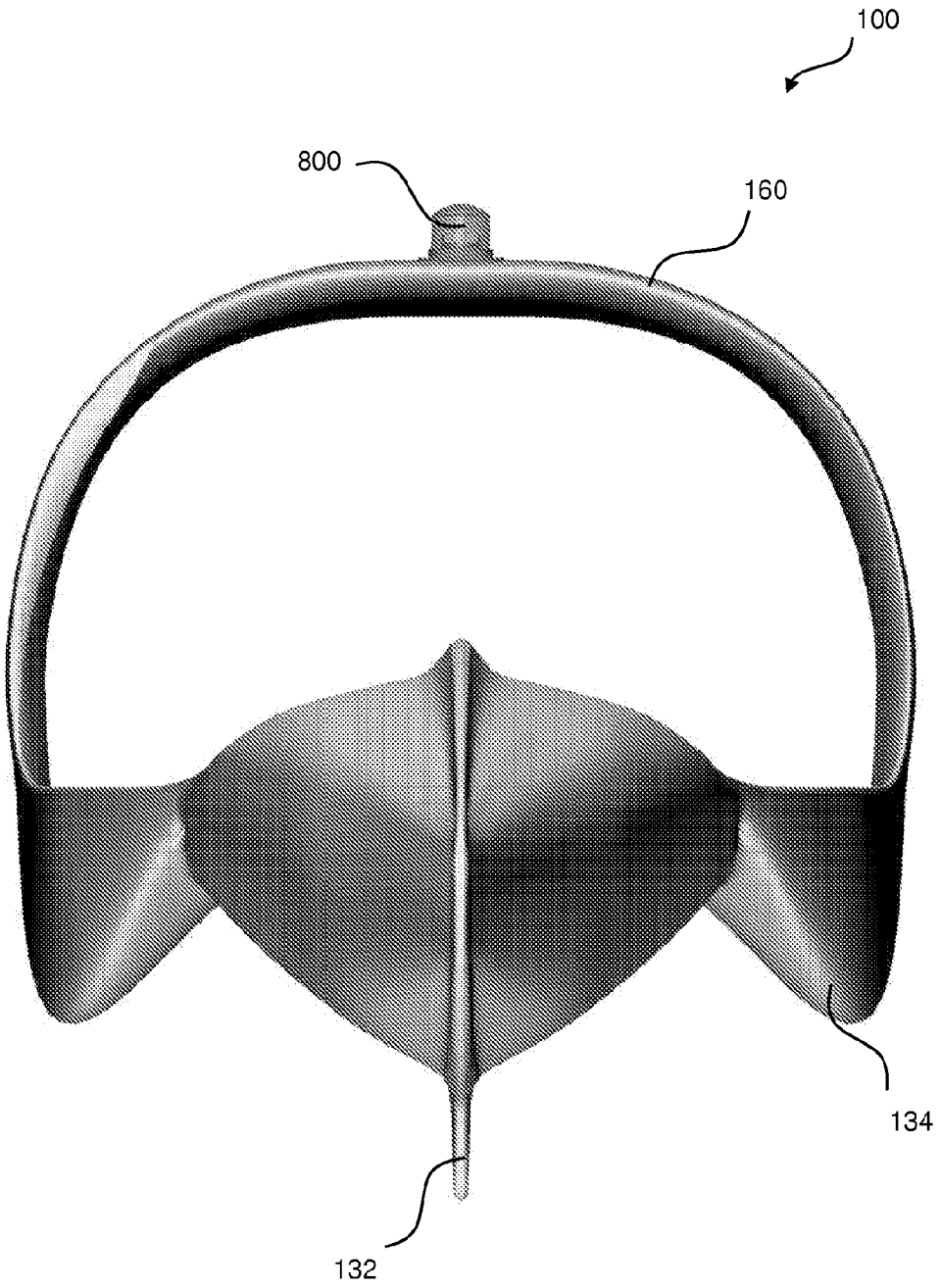
FIG. 5 is a front elevation of the safety buoy of FIG. 1.
Figure 6:
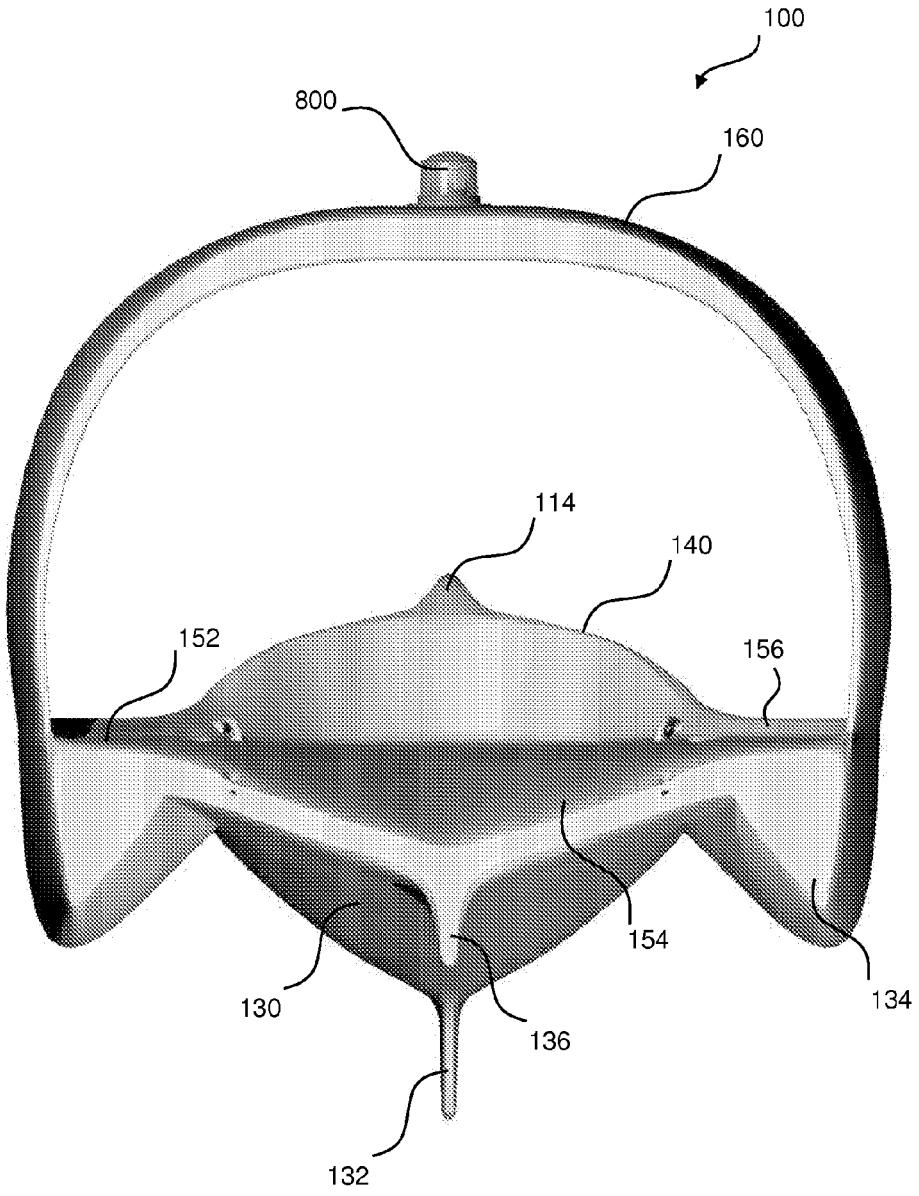
FIG. 6 is a rear elevation of the safety buoy of FIG. 1.
Figure 7:
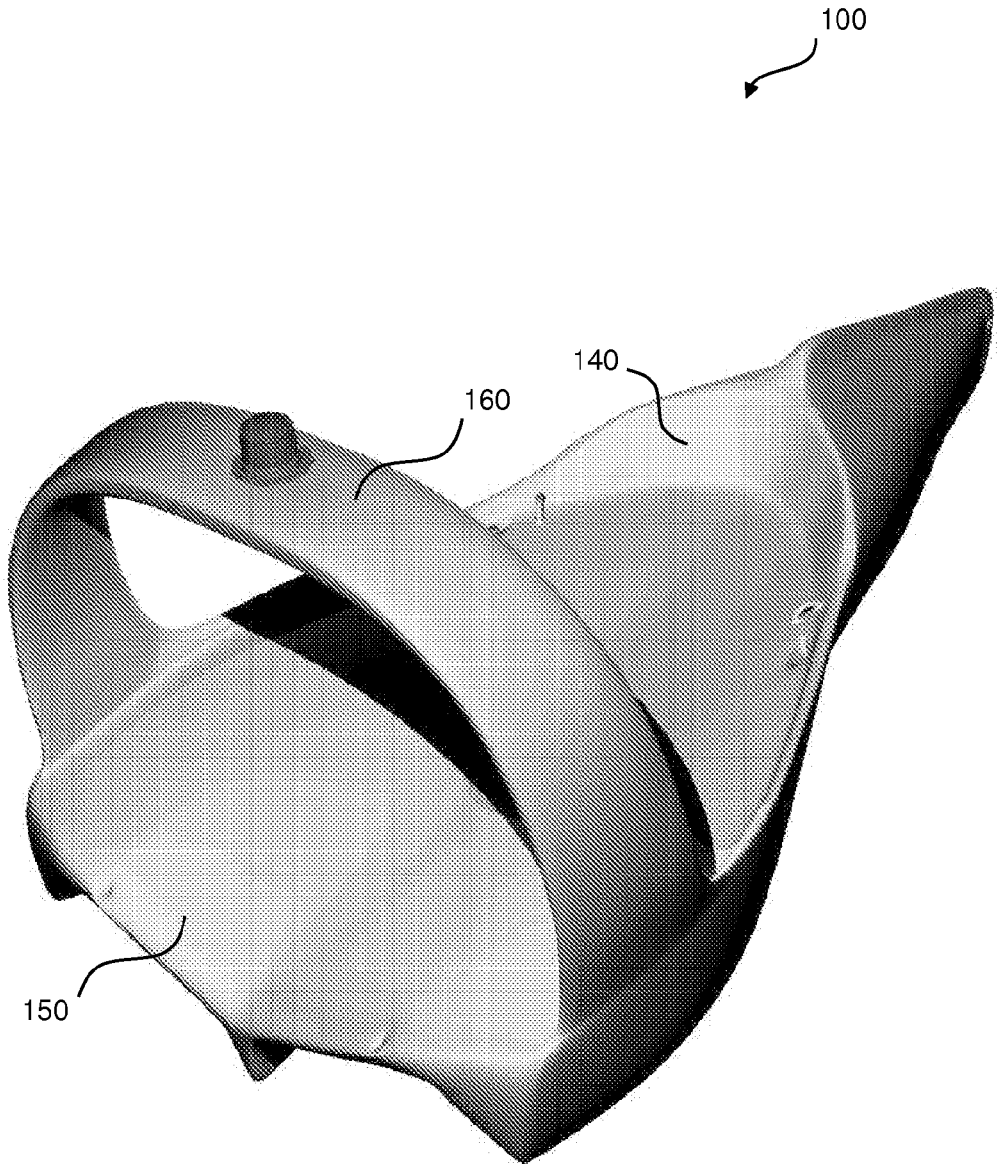
FIG. 7 is a perspective view of the safety buoy of FIG. 1, from a top rear aspect.
Figure 8:
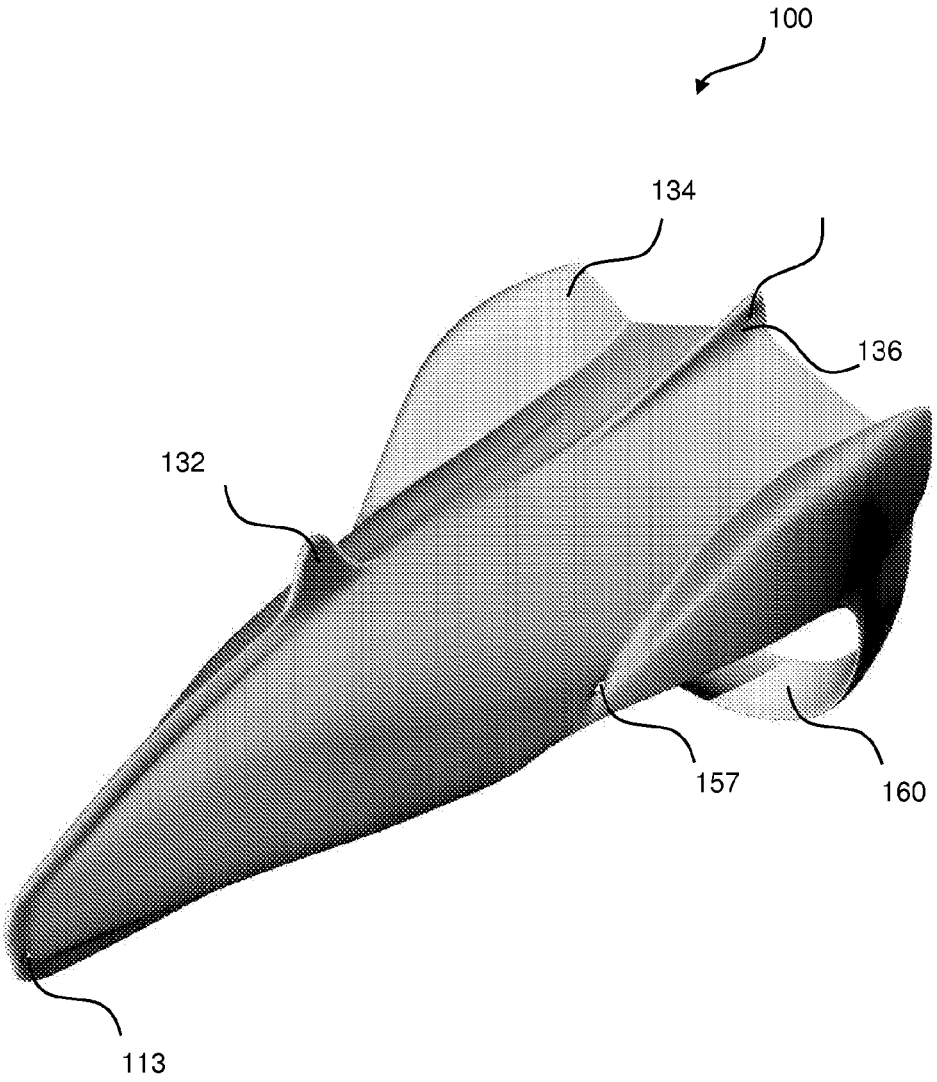
FIG. 8 is a perspective view of the safety buoy of FIG. 1, from a front underside aspect.

As described, FIGS. 2 to 8 depict the shape of safety buoy 100, from various perspectives. More particularly, FIG. 2 depicts a side elevation, while FIG. 3 depicts a plan view, and FIG. 4 depicts the underside. FIGS. 5 and 6 depict front and rear elevations, while FIGS. 7 and 8 depict perspective views respectively from a top rear perspective, and from a front underside perspective.

Referring to FIG. 2, the safety buoy 100 has at the fore a bow 110, and aft a stern 120. The safety buoy 100 may desirably be dimensioned so that its length from fore to aft is approximately 3000 mm, and its width at a widest portion is approximately 1500 mm, relative lengths of the bow 110 and stern 120 are approximately 1000 mm and 2000 mm respectively. The height of the safety buoy 100 is approximately 700 mm, while the reach of the targa bar 160 is approximately 1200 mm.

These dimensions are not exact, and are referenced as merely indicative of exemplary dimensions adopted in a preferred embodiment. These dimensions can be adjusted to suit differing requirements, conditions or applications, as will be appreciated. As an example, different sizes may be used, and a 'lighter duty' buoy may be constructed at two-thirds of the abovementioned dimensions, suitable for use in marine estuaries, for example, where conditions are less rough than open roughwater. Conversely, an 'oversized' buoy, at one-and-a-half size, for particularly unfavourable conditions. Proportions can also be adjusted as required.

Referring to FIGS. 4, 5 and 6, the bow 110 of the buoy 100 has a hard chine, as depicted, which extends along the underside of the bow 110 to a keel 132, which is most clearly depicted in elevation in FIG. 2 and in perspective in FIG. 8.

The topside of the bow 110 is generally streamlined, nothwithstanding a crowning ridge 116, most clearly depicted in FIG. 3, which runs along the centre and uppermost part of the bow 110, and which divides the bow 110 into opposing side halves. The crowning ridge 116 leads from the prow 112 to the bulwark 140, which is formed in an arc or crescent-shaped arrangement, as most clearly depicted in FIG. 3 and FIG. 7. The bulwark 140 extends across of the buoy 100 from port to starboard, and generally separates the bow 110 and stern 120. The bulwark 140 provides a measure of shelter from incoming swell conditions.

Progressing from fore to aft of the buoy 100, the bulwark 140 leads to the stern 120, which features an open decked area in the form of a deck 150 and, beneath, the hull 130. The deck 150 is generally open and flat, but near its centre or middle is slightly concaved or recessed. The hull 130 has a complex, undulating shape, as depicted most clearly in FIG. 8, but can be generally characterised as concaved, from the perspective of the deck 150. The hull 130 is flanked both port and starboard by sponsons 134. The sponsons 134, while integral with the hull 130 as is typical, are to some extent akin to pontoons or outriggers, insofar as they lend buoyancy and stability to the buoy 100. The sponsons 134 serve to extend the hull 132 at or below the waterline, as depicted, and thereby serve to increase buoyancy and flotation of the buoy 100. The shape and dimension or the sponsons 124 can be adapted as required to accommodate different levels or buoyancy or stability, according to requirements.

On the hull 130, between the sponsons 134, is a central fin 136 which extends along approximately the final one-third of the length of the buoy 100, terminating at the end of the stern section 120. Formed in the central fin 136 is a mooring hole 138, which complements prow hole 114 formed at a leading section of the streamlined prow 112. These holes 114, 138 can be used for mooring the buoy 100 fore and aft as described.

The open deck area or deck 150 is slightly recessed or concaved. Consequently, the deck 150 may be considered to comprise side decks 152, which are generally flat or horizontal, which transitions into a concaved middle deck 154 that extends therebetween. The middle deck 154 is thus of a slightly concaved or chevron-shaped orientation, somewhat akin to the hull 130 beneath. The side decks 152, which transition into the middle deck 154, are positioned above the sponsons 134 formed in the hull 130.

At the stern 120 there is, extending from the deck 150, a targa bar 160, which reaches and extends over the deck 150 and has a generally curved profile as depicted. The targa bar 160 assists in stability of the buoy 100 in rough conditions. The targa bar 160 is adapted to make the buoy 100 self-righting, should the buoy 100 overturn due to prevailing conditions, or at least make the buoy easier to right manually.

At a mid point of the targa bar 160 over the deck 150, where the bar 160 reaches its zenith, there is located as depicted a navigational light and strobe unit 800, which is described in further detail below.

Extending along both sides of the buoy 100 between the ends of the bulwark 140 and respective ends of the targa bar 160 are splash rails 156 formed along the port and starboard gunwales of the stern 120. The splash rails 156 project a small distance above the side decks 152, and in this respect guard the deck 150 to some extent against wash from the sea.

General purpose lugs 158 are formed on the shell of the buoy 100, located at both sides of the buoy 100 in those regions where the bulwark 140 transitions into the splash rails 156. The lugs 158 can be used alone or in combination to help secure items to the buoy 100, or used as a securing point for marine rope as required.

Adjacent the lugs 158 are side voids 157, formed as small holes or apertures through the buoy 100, provided near where the bulwark 140 transitions into the splash rails 156 and, on the underside of the buoy 100, near the front of the sponsons 134, where the sponsons 134 transition into the hull 130. The side voids 157 may be used for a similar purpose as the lugs 158.

Complementing the side voids 157 are rear voids 159, formed as a pair at the rear of the stern 120 of the buoy 100, at the stern transom, on respective sides of the buoy 100, near where the side decks 152 meet the middle deck 154 and, on the underside the buoy 100, near where the sponsons 124 meet the hull 122. The side voids 157 and the end voids 159 are suitably dimensioned to allow a marine rope to pass through, and in this respect, a line may extend through the prow hole 114, through the side voids 157 and along to the end voids 159, where the ends of the line can be secured by suitable knots. This places the line near the waterline at the bow 110 when the buoy 100 is in the water, where the line can be grabbed if need be, and along the side decks 152 of the buoy 100, where the line can serve a similar purpose. Similarly, a line secured to the buoy 100 in this way can be used for carrying the buoy 100, when required.

Referring to FIG. 8, the keel 132, in combination with the sponsons 134 and central fin 136 act to stabilize the buoy 100, which as depicted and described, is of a relatively low-profile design. Furthermore, the design of the buoy 100 is such that the bow 110 has sufficient buoyancy relative to the stern 120 to allow sufficient stability during anticipated use, both to allow stable positioning in a rip current, as well as providing buoyancy to a swimmer seeking the assistance of the buoy 100.

The central fin 136 has a hole 137 formed therein through which the floating lifeline 170 may be secured, as depicted in FIG. 1.

The safety buoy 100 advantageously uses electronic communications equipment to provide various tracking and monitoring features.

Figure 9:
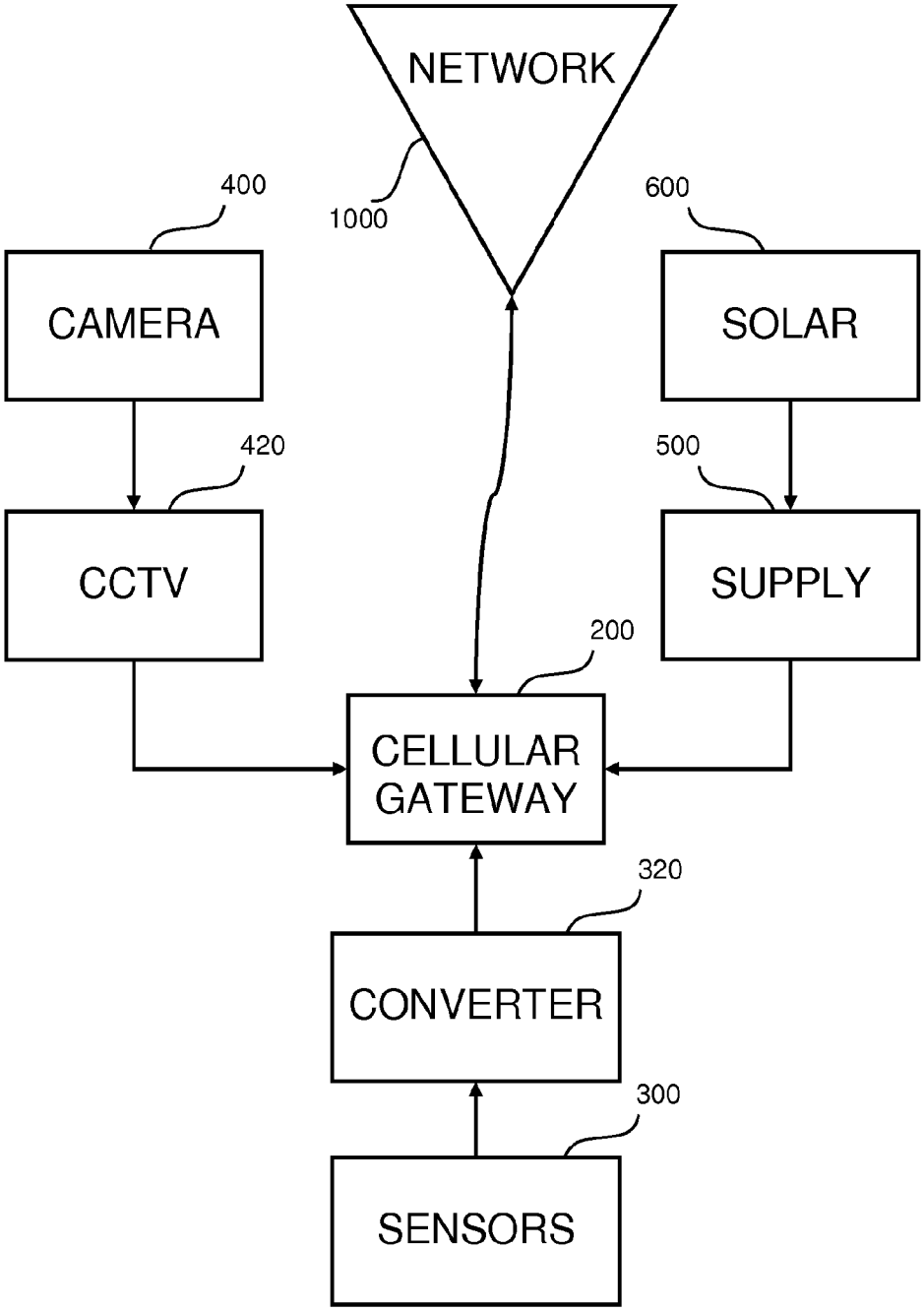
FIG. 9 is a schematic view of circuitry incorporated in a safety buoy fitted with an emergency radio beacon.

FIG. 9 is a high-level schematic diagram of control circuitry for a monitoring system embedded in the buoy 100. The heart of the system is a cellular gateway 200, which is a wireless modern that transmits to a wireless cellular network 1000. A number of solar panels 600 can be deployed on the buoy 100, preferably on the targa bar 160 (where exposed to sunlight, and removed from the waterline), which trickle feeds a power supply 500, which supplies power to the cellular gateway 200 (and any other direct on-board power draws) at 12V. A series of environmental sensors 300 collect environmental data relating to current speed, temperature, and any other environmental parameters deemed applicable, which data is provided to a converter 320, which receives this data via a RS 485 interface, and outputs converted data in NMEA 2000 protocol, which is typically used to create a network of electronic devices—chiefly marine instruments—on marine craft. After conversion, this data is provided to the cellular gateway 200, for transmission into the cellular network 1000.

Also, a camera 400 can be mounted on the buoy 100, with a signal fed to a CCTV recording device, with on-transmission to the cellular gateway 200, and from there to the cellular network 1000. Preferably, the camera 400 can be mounted on the bulwark 140, and provides a wide-angle, panoramic, fish-eye-like perspective of the deck 150 and the rip current area 35 beyond.

This arrangement, depicted in FIG. 9, allows information from multiple buoys to be monitored and recorded at a central location, by interface via the Internet to the cellular network 1000.

Preferably, data transmitted to the cellular network 1000 is monitored and received by information technology infrastructure able to provide various monitoring and recording capabilities. A provider such as Global Ocean Security Technologies (GOST) of Florida, United States of America, which specialises in electronic monitoring, tracking and surveillance in marine environments, can provide such capabilities.

Preferably, operating in parallel and in conjunction with the above described electronic monitoring system is an emergency alert system supported also by GOST or a similar provider, and activated by a manual switch on the buoy 100, which in turn activates the navigational light and strobe unit 800 to a strobing distress signal. This emergency alert system also activates an emergency radio beacon which communicates direct to a satellite network.

A suitably configured electronic control unit (ECU) is used to operate the navigational light and strobe unit 800, and the emergency radio beacon. A manually-operated switch is connected directly to the ECU. A power supply unit 500, as described above, is used to provide power supply to the ECU, strobe unit 800 and associated radio beacon. When the switch is activated, the ECU activates the radio beacon and the strobe 800. The strobe 800 when activated by the switch emits a high-intensity day and night blue strobe to indicate a distress signal, as recognised by international convention.

The strobe unit 800 desirably operates automatically outside of daylight hours from dusk until dawn, and emits a flashing yellow strobe at any desired rhythm, which designates a special mark according to the internationally recognised uniform coding system used for navigation marks. The flashing yellow strobe is able to be selectively deactivated to conserve electrical power reserves.

The emergency radio beacon is any suitable wireless communications transmitter or transceiver system, and is conveniently one operating via a mobile telephony network with local coverage, and preferably also equipped with GPS (Global Positioning System) capability. The network may, for example, be a prevailing GSM (Global System for Mobile Communications) network as operates in Australia and many other countries worldwide. The beacon operates by regularly determining its position via GPS signals, and transmitting an emergency signal under direction from the ECU via a satellite network to a base station, that registers the emergency signal.

This base station may be configured to issue communications alerts, such as via SMS (Short Message Service) to pre-registered mobile telephone numbers or email to email addresses in case of activation of the beacon. The beacon can preferably reset remotely via a web interface that is in communication with the base station.

Advantageously, the base station can send an alert to a hardware unit intended to be located on a nearby shore location, such as an adjacent beach. In this case, the hardware unit is configured to issue a loud audible warning that alerts attention to the nearby safety buoy 100. Various implementations, configurations and features of the beacon and co-operating network and base station can be envisaged, depending on requirements, intended use and any applicable regulations.

The buoy 100 is constructed as follows, fabricated in using a two-piece mould. A frame of stainless steel, and having a keel, is fitted to the mould. The inside surface of the mould is sprayed with aliphatic ultraviolet-stabilised (UV-stabilised) polyurea coating, followed by application, also by spraying, with a structural polyurea coating. The shell is then mouded of grade 3979 polyethylene, which is a high-strength UV-stabilised form of polyethylene.

The electronic componentry described herein is housed in a waterproof jacket, positioned within the buoy 100. The mould pieces are joined, with the frame located internally, and the core is filled with a polyurethane pour foam, with the targa bar 160 formed similarly.

The shell desirably has an access opening (not shown), which allows access into an internal cavity within the buoy 100, and for the shell to be filled once the buoy 100 is internally constructed with a suitable foam core. The safety buoy 100 is preferably bright 'signal yellow' in colour, as the safety buoy 100 can be used as a marine navigational marker.

Within the shell of the safety buoy 100, there is preferably an internal rigid frame, for improving the rigidity of the safety buoy 100. Such a frame is desirably formed in stainless steel, and ideally marine grade 316 stainless steel, to assist in resisting corrosion.

An alternative embodiment may omit various optional features of the safety buoy described above, and may also be of different proportions. As an example, an alternative embodiment may omit a light and strobe unit and associated electronics. Such units are intended for day-to-day use on surf beaches, where the buoys can be towed by IRB or jet ski to a suitable mooring point and anchored at the discretion of lifesavers wherever prevailing rips are found. Such buoys can be monitored visually from the shore or a patrol tower by lifesavers who can then take appropriate measures should a bather caught in a rip access the buoy to prevent being carried further out to sea.

A safety buoy may also incorporate additional features, such as a whip antenna. The whip antenna can be removably affixed to the bow of the safety buoy and optionally equipped with a flag, intended primarily to assist in sighting the buoy from water or land, especially in heavy swell conditions. The whip antenna is advantageously made of a robust flexible construction of the type typically used with, for example, recreational vehicles, and also suitable for use in a marine environment exposed to gusting winds, salt and ultraviolet radiation. Such a whip antenna may also be used to assist in transmitting and receiving signals to and from the beacon.

Various other additions or alterations may be made to the embodiments described above, as would be apparent to a person skilled in the art of marine safety or other relevant arts, without departing from the spirit and scope of the invention.

The invention claimed is:

1. A safety buoy for use in a rip current area, the safety buoy comprising a bow, a stern and a hull, the bow having a streamlined prow and the stern having an open decked area above the hull, wherein a targa bar extends from and over the open decked area of the stern, and wherein, the safety buoy can be moored such that the streamlined prow generally faces seaward towards an incoming swell, and the open decked area generally faces shoreward towards an outgoing rip current, the open decked area thereby providing a resting platform for bathers caught in the rip current area.

2. The safety buoy according to claim 1, further comprising a bulwark extending port to starboard and separating the bow and the stern for sheltering the opendeck area from incoming swell.

3. The safety buoy according to claim 1, further comprising sponsons integral with and formed in the hull at the stern.

4. The safety buoy according to claim 1, further comprising a keel integral with and extending from the hull adjacent the bow.

5. The safety buoy according to claim 4, further comprising a central fin integral with and extending from the hull and aligned with the keel.

6. The safety buoy according to claim 1, further comprising at least one of a navigational light and strobe unit mounted on the targa bar.

7. The safety buoy according to claim 1, further comprising splash rails extending along port and starboard gunwales from stern transom towards the bow.

8. The safety buoy according to claim 1, wherein mooring points are located both fore and aft.

9. The safety buoy according to claim 1, wherein the prow is a straight prow.

10. The safety buoy according to claim 1, wherein the open decked area is concavely recessed towards the middle of the hull.

11. The safety buoy according to claim 1, further comprising a fixing point located at the stern for removably securing a floating lifeline that operatively trails behind the safety buoy.

12. The safety buoy according to claim 1, further including an emergency radio beacon operable by a manual switch mounted on the buoy for transmitting a radio distress signal to an emergency radio network.

13. The safety buoy according to claim 1, wherein the buoy is formed of an impervious shell enclosing a rigid frame and a foam core.

14. The safety buoy according to claim 1, further comprising at least one of an emergency radio beacon and an environmental monitoring system embedded within the safety buoy.

15. A safety buoy for use in a rip current area, the safety buoy comprising a bow, a stern and a hull, the bow having a streamlined prow and the stern having an open decked area above the hull which is concavely recessed towards the middle of the hull, wherein the safety buoy can be moored such that the streamlined prow generally faces seaward towards an incoming swell, and the open decked area generally faces shoreward towards an outgoing rip current, the open decked area providing a resting platform for bathers caught in the rip current area.

16. The safety buoy according to claim 15, further comprising a bulwark extending port to starboard and separating the bow and the stern for sheltering the open deck area from incoming swell.

17. The safety buoy according to claim 15, further comprising sponsons integral with and formed in the hull at the stern.

18. The safety buoy according to claim 15, further comprising a keel integral with and extending from the hull adjacent the bow.

19. The safety buoy according to claim 18, further comprising a central fin integral with and extending from the hull and aligned with the keel.

20. The safety buoy according to claim 15, further comprising a targa bar extending from and over the open decked area of the stern.

21. The safety buoy according to claim 20, further comprising at least one of a navigational light and strobe unit mounted on the targa bar.

22. The safety buoy according to claim 15, further comprising splash rails extending along port and starboard gunwales from stern transom towards the bow.

23. The safety buoy according to claim 15, wherein mooring points are located both fore and aft.

24. The safety buoy according to claim 15, wherein the prow is a straight prow.

25. The safety buoy according to claim 15, further comprising a fixing point located at the stern for removably securing a floating lifeline that operatively trails behind the safety buoy.

26. The safety buoy according to claim 15, further including an emergency radio beacon operable by a manual switch mounted on the buoy for transmitting a radio distress signal to an emergency radio network.

27. The safety buoy according to claim 15, wherein the buoy is formed of an impervious shell enclosing a rigid frame and a foam core.

28. The safety buoy according to claim 15, further comprising at least one of an emergency radio beacon and an environmental monitoring system embedded within the safety buoy.

* * * * *